US010132588B2

(12) United States Patent
Salvador

(10) Patent No.: US 10,132,588 B2
(45) Date of Patent: Nov. 20, 2018

(54) SOUND SUPPRESSOR ATTACHMENT SYSTEM AND METHOD

(71) Applicant: Joseph Salvador, Wilbraham, MA (US)

(72) Inventor: Joseph Salvador, Wilbraham, MA (US)

(73) Assignee: DAVINCI ARMS LLC, Ludlow, MA (US)

( * ) Notice: Subject to any disclaimer, the term of this patent is extended or adjusted under 35 U.S.C. 154(b) by 0 days.

(21) Appl. No.: 15/441,438

(22) Filed: Feb. 24, 2017

(65) Prior Publication Data

US 2017/0261281 A1 Sep. 14, 2017

Related U.S. Application Data

(60) Provisional application No. 62/306,148, filed on Mar. 10, 2016.

(51) Int. Cl.
*F41A 21/32* (2006.01)
*F41A 21/30* (2006.01)

(52) U.S. Cl.
CPC ..... *F41A 21/325* (2013.01)

(58) Field of Classification Search
CPC ..... F41A 21/30; F41A 21/32; F41A 21/325
USPC ..... 89/14.4; 181/223
See application file for complete search history.

(56) References Cited

U.S. PATENT DOCUMENTS 5,698,810 A * 12/1997 Rose ..... F41A 21/32 42/97
8,997,621 B1 * 4/2015 Dater ..... F41A 21/325 89/14.3
9,182,187 B1 * 11/2015 Griffith ..... F41A 21/32
2011/0203152 A1 * 8/2011 Dueck ..... F41A 21/30 42/90
2012/0103176 A1 * 5/2012 Latka ..... F41A 21/30 89/14.4
2014/0075818 A1 * 3/2014 Piontek ..... F41A 21/10 42/77
2015/0267986 A1 * 9/2015 Sellars ..... F41A 21/485 89/14.4
2016/0109205 A1 * 4/2016 Coppinger ..... F41A 21/30 89/14.4
2016/0209150 A1 * 7/2016 Smith ..... F41A 21/30
2016/0209151 A1 * 7/2016 Smith ..... F41A 21/30
2017/0097205 A1 * 4/2017 Palu ..... F41A 21/325
2017/0184367 A1 * 6/2017 Odle ..... F41A 21/325

* cited by examiner

*Primary Examiner* — Bret Hayes

(57) ABSTRACT

An attachment system for attaching an accessory to the muzzle end of a firearm includes an accessory such as a silencer or sound suppressor, a muzzle adapter, and a multi-functional assembly, disassembly and locking device that locks the muzzle adapter onto the body of the suppressor. An end of the device is also configured to mate with the muzzle adapter to provide torque to selectively assemble or disassemble the muzzle adapter to the suppressor.

15 Claims, 4 Drawing Sheets

SOUND SUPPRESSOR ATTACHMENT SYSTEM AND METHOD

CROSS-REFERENCE TO RELATED APPLICATIONS

This application claims the benefit of U.S. Provisional Application Ser. No. 62/306,148, filed on Mar. 10, 2016, which is hereby incorporated by reference herein in its entirety.

FIELD OF THE INVENTION

The present invention relates generally to firearms and, more particularly, to a system and method for quickly attaching an accessory, such as a sound suppressor, to the muzzle of a firearm.

BACKGROUND OF THE INVENTION

Various systems and methods have been developed for use in the attachment of accessories to the muzzle of a firearm. These accessories may include silencers, flash suppressors, rocket and/or grenade launchers, line launchers, and the like. The reliability of the connection of the muzzle accessory and muzzle, and the ease or quickness with which the accessory is secured and removed, tend to provide competing objectives. For example, large numbers of fine threads and locking pins typically provide a very reliable connection but require a relatively long amount of time to secure or remove and may require the use of special tools.

Conversely, smaller numbers of threads and the lack of redundant locking features may facilitate the quick attachment and detachment of the accessory, but can also lead to undesirable loosening of the accessory from the firearm. This is particularly undesirable, as loosening of the accessory can compromise axial alignment of the accessory, increasing the possibility of a projectile impacting, for example, a baffle or end closure of the accessory.

Moreover, where muzzle adapters are utilized to attach the accessory to the firearm, loosening of the accessory from the muzzle adapter can lead to complete disassembly of the accessory from the muzzle adapter while the muzzle adapter may become stuck to the host firearm. In such a situation, disassembly of the firearm may be necessary to retrieve the muzzle adapter.

In view of the above, there is a need for a system and method for attaching and detaching a sound suppressor or other accessory to a firearm, and which prevents inadvertent loosening of the sound suppressor relative to the firearm or muzzle adapter.

SUMMARY OF THE INVENTION

It is an object of the present invention to provide a system and method for attaching an accessory to a firearm.

It is another object of the present invention to provide a system for attaching a suppressor or silencer to the muzzle of a firearm.

It is another object of the present invention to provide a system for reliably and securely attaching a suppressor or silencer to the muzzle of a firearm.

It is another object of the present invention to provide a system for attaching a suppressor or silencer to the muzzle of a firearm, which prevents inadvertent loosening of the suppressor or silencer relative to the firearm.

It is another object of the present invention to provide a system for attaching a suppressor or silencer to the muzzle of a firearm which includes a device that enables assembly or disassembly of the suppressor.

It is another object of the present invention to provide a system for attaching a suppressor or silencer to the muzzle of a firearm which includes a device that prevents unintended or inadvertent disassembly of the suppressor from the firearm.

It is another object of the present invention to provide a system for attaching a suppressor or silencer to the muzzle of a firearm which includes an integrated device that enables loosening or disassembly of the suppressor.

These and other objects are achieved by the present invention.

According to an embodiment of the present invention, an attachment system for attaching an accessory to the muzzle end of a firearm includes an accessory such as a silencer or sound suppressor, a muzzle adapter, and a multi-functional assembly, disassembly and locking device that locks the muzzle adapter onto the body of the suppressor. An end of the device is also configured to mate with the muzzle adapter to provide torque to selectively assemble or disassemble the muzzle adapter to the suppressor.

According to another embodiment of the present invention a tool for locking a sound suppressor to a muzzle adapter, and for applying torque to assemble or disassemble the sound suppressor to and from the muzzle adapter includes a generally cylindrical body having internal threads formed at one end thereof for engaging corresponding threads on an external surface of a body of the sound suppressor, and an opening in an end of the cylindrical body opposite the internal threads. The opening is sized and shaped to engage a correspondingly sized and shaped feature on the muzzle adapter to facilitate loosening or tightening of the same with respect to the sound suppressor.

According to another embodiment of the present invention, a method for attaching a firearm accessory to a firearm includes the steps of receiving an engagement surface of a muzzle adapter within a correspondingly shaped opening in a proximal end of a multi-function retaining device, inserting a distal end of the muzzle adapter into a proximal end of a muzzle accessory, and applying torque to the multi-function retaining device to rotate the retaining device and muzzle adapter relative to the muzzle accessory to secure the muzzle accessory to the retaining device.

According to yet another embodiment of the present invention, a system for attaching a muzzle accessory to a muzzle of a firearm includes a muzzle adapter configured for attachment to a muzzle of a firearm, a muzzle accessory configured for attachment to the muzzle adapter, and a retaining device having a first end configured to receive the muzzle accessory and a configured to exert a compressive force on the muzzle adapter.

BRIEF DESCRIPTION OF THE DRAWINGS

The present invention will be better understood from reading the following description of non-limiting embodiments, with reference to the attached drawings, wherein below.

DETAILED DESCRIPTION OF THE PREFERRED EMBODIMENT

Figure 1:
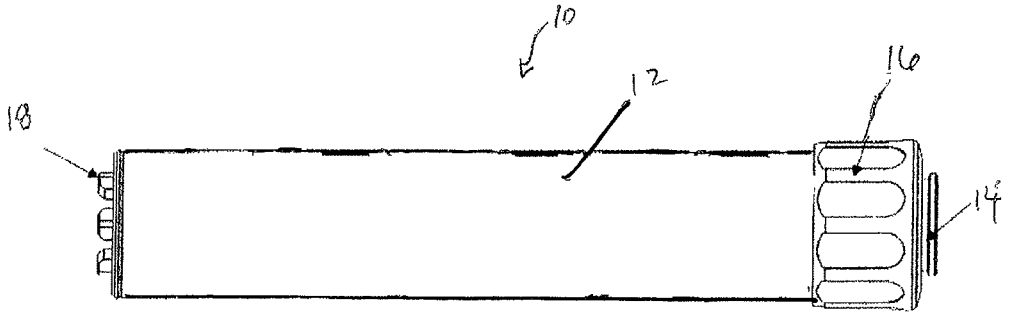
FIG. 1 is a side, elevational view of a system for attaching an accessory to a firearm according to an embodiment of the present invention.
Figure 2:
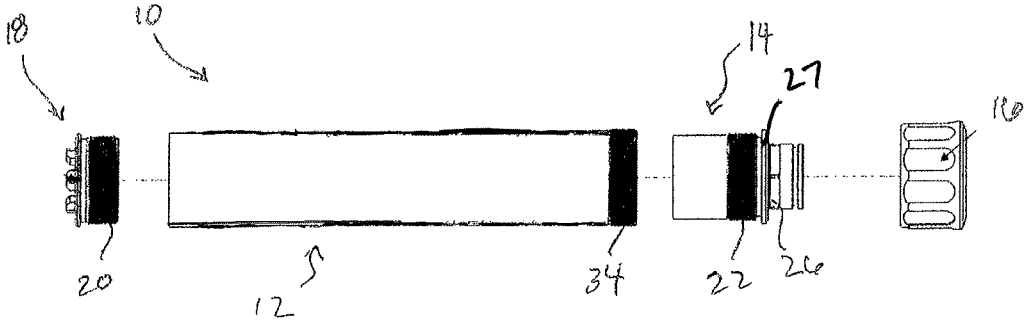
FIG. 2 is an exploded view of the system of FIG. 1.

Referring to FIGS. 1 and 2, an attachment system 10 for attaching an accessory to the muzzle a firearm is illustrated. While the embodiments described herein illustrate the accessory as a sound suppressor, the accessory may be a recoil reducing device, flash suppressor or other device configured for attachment to the muzzle of a firearm. The attachment system includes an accessory such as a silencer or sound suppressor 12, a muzzle adapter 14, and a multi-functional assembly, disassembly and locking/retaining device 16. As best shown in FIG. 2, the sound suppressor 12 defines a generally cylindrical body having internally threaded portions (not shown) formed at the forward and rearward ends, respectively, thereof. The internal threads on the forward end of the suppressor 12 are configured to mate with corresponding threads 20 of an end cap 18 of the suppressor 12, thereby enabling the selective removal and attachment of the end cap 18 to the suppressor. The internal, female threads on the rearward (proximal) end of the suppressor 12 are configured to mate with corresponding male threads 22 formed on the external surface of the muzzle adapter 14, enabling the selective attachment and removal of the suppressor 12 from the muzzle adapter 14. In an embodiment, the threads 22 and corresponding internal threads of the suppressor 12 are right-handed threads.

Figure 3:
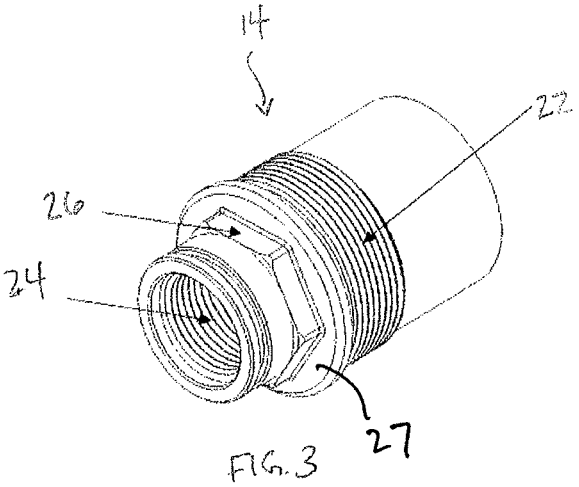
FIG. 3 is a perspective view of a muzzle adapter of the system of FIG. 1.
Figure 4:
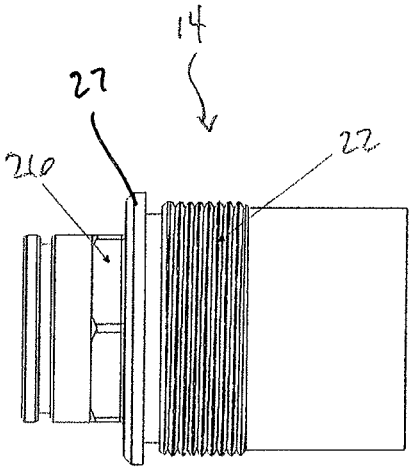
FIG. 4 is a side, elevational view of the muzzle adapter of FIG. 3.

Referring now to FIGS. 2 and 3, the muzzle adapter 14 is more clearly illustrated. As shown, the proximal end of the muzzle adapter 14 includes a female threaded portion 24 that is configured to mate with a corresponding male threaded portion on the muzzle of a firearm (not shown). In an embodiment, the threaded portion 24 includes a plurality of right-handed threads. The female threaded portion 24 allows the muzzle adapter 14 to be threaded onto the muzzle of a host firearm concentric with the firing axis of the firearm. As also shown in FIGS. 3 and 4, the muzzle adapter 14 also includes a hexagonal gripping feature 26 or engagement surface, the purpose of which will be described hereinafter. While the feature 26 is illustrated as being hexagonal, the feature 26 may take other shapes, such as square, octagonal and the like. An annular flange 27 separates the threaded portion 22 from the engagement surface 26.

Figure 5:
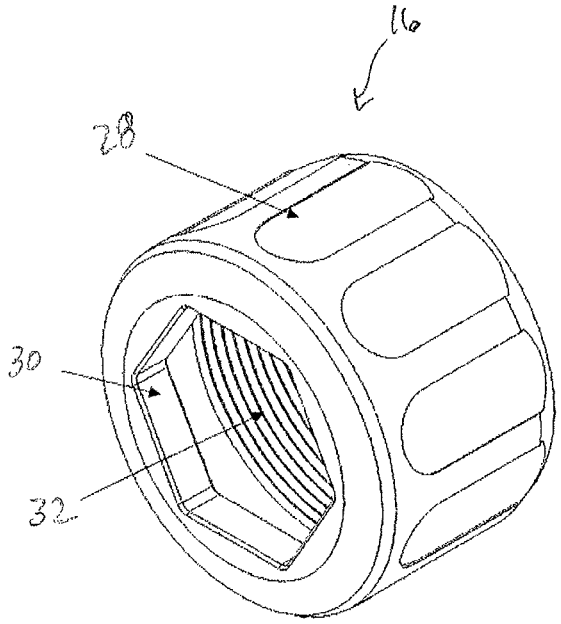
FIG. 5 is a perspective view of an assembly, disassembly and locking device of the system of FIG. 1.
Figure 6:
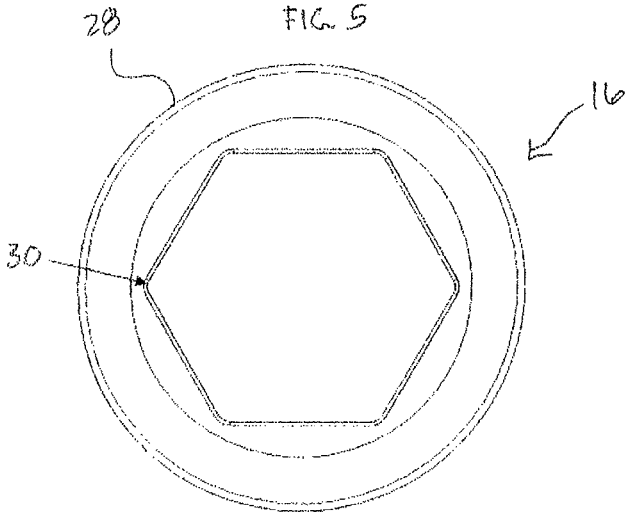
FIG. 6 is an end view of the assembly, disassembly and locking device of FIG. 5.
Figure 7:
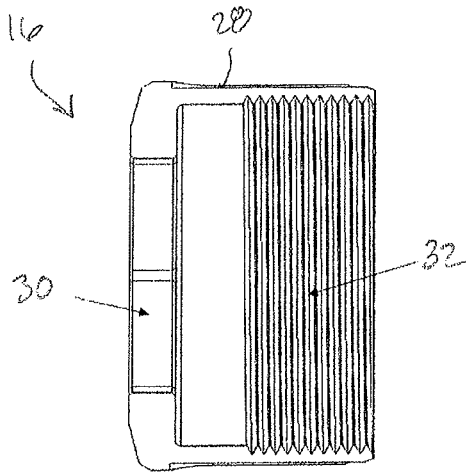
FIG. 7 is a partial cross-section, side elevational view of the assembly, disassembly and locking device of FIG. 5.

Turning now to FIGS. 5-7, the multi-functional assembly, disassembly and locking/retaining device 16 (also referred to herein as a takedown tool or takedown device) is best illustrated. The device 16 is generally cylindrical in shape and includes a textured or grooved surface 28 formed on the outer periphery thereof. As best shown in FIGS. 5 and 6, the device 16 includes an opening 30 at one end that is keyed to or otherwise corresponds in size and shape to the engagement surface 26 of the muzzle adapter 14. For example, in an embodiment, the opening 30 may be hexagonal in shape and sized to receive the hexagonal gripping feature 26 of the muzzle adapter 14. As also shown therein, an internal surface of the device 16 opposite the opening 30 is formed with threads 32. The threads 32 are configured to mate with a correspondingly threaded portion 34 on the outer surface of the proximal end of the suppressor 12 in order to secure the device 16 to the suppressor 12, as discussed hereinafter. In an embodiment, the threaded portion 34 includes a plurality of left-handed threads configured to mate with the threaded portion 32 of the retaining device 16, which also includes a corresponding plurality of left-handed threads.

Referring once again to FIGS. 1 and 2, in operation, the muzzle adapter 14 may be coupled to the body of the suppressor 12 by threading the adapter 14 into the suppressor body using threaded portion 22 and the corresponding internal threaded portion of the suppressor 12. The end of the retaining device 16 with the opening 30 may then be mated with the engagement surface 26 of the muzzle adapter 14. In particular, the device 16 may be engaged with the engagement surface 26 such that surface 31 of the device 16 contacts the flange 27 of the muzzle adapter 14. The retaining device or takedown tool 16 may then be rotated to thereby rotate the muzzle adapter 14 until it is tightly mated to the body of the suppressor 12. In this manner, the takedown tool 16 functions like a wrench to apply torque to the muzzle adapter 14 to tighten the muzzle adapter 14 to the suppressor 12.

Once the muzzle adapter 14 is tightened, the takedown tool 16 may be flipped around slid over the muzzle adapter towards the suppressor body so that the threaded portion 32 aligns with threaded portion 34 on the suppressor 12. As the takedown tool 16 is rotated anti-clockwise relative to the suppressor 12, the internal threaded portion 32 of the takedown tool 16 engages the corresponding threaded portion 34 on the outer peripheral surface of the suppressor body. As the takedown tool 16 is further rotated, it bears against the flange 27, putting the muzzle adapter 14 in compression relative to the suppressor 12. The compression with opposite threaded features (i.e., left-handed threads) prevents the muzzle adapter 14 from being unintentionally disassembled from the suppressor 12.

The muzzle adapter 14 (with attached suppressor 12) may then be threaded onto the muzzle of a firearm. Importantly, the gripping surface 28 of the retaining device 16 may be utilized to apply torque to the entire assembly, tightening the assembly 10 to the muzzle of the firearm while at the same time further putting the muzzle adapter 14 in compression relative to the suppressor 12. Importantly, the left-handed threads 32 of the retaining device 16 act in the direction of tightening when the right-handed threads 24 of the muzzle adapter 14 attempt to loosen. In the assembled position shown in FIG. 1, the muzzle adapter 14 is restricted from moving due to being in compression from the assembly of the retaining device 16 in its fully seated position (i.e., the device 16 puts the muzzle adapter 14 under compression relative to the body of the suppressor 12). In this respect, the device 16 locks the threaded muzzle adapter 14 onto the suppressor body 12, and prevents the muzzle adapter 14 from being unintentionally loosened or disassembled.

As disclosed above, in addition to providing a locking function preventing the loosening of the sound suppressor 12 from the muzzle adapter 14 during use, the device 16 also assists in the assembly and disassembly of the sound suppressor 12. In particular, the hexagonal opening 30 of the device 16 is configured to mate with the corresponding hexagonal feature 26 on the muzzle adapter 14, allowing the device 16 to be utilized as a wrench-like tool to selectively tighten or loosen (for assembly or disassembly) the muzzle adapter 14 relative to the suppressor body 12.

For example, when connecting the suppressor body 12 to the muzzle adapter 14, the device 16 may be utilized to apply torque to the adapter 14 in order to tightly secure the adapter 14 to the suppressor body. Conversely, when the device 16 is removed from the suppressor body 12 and flipped 180 degrees, the female hex feature 30 can be used to engage the male hex feature 26 of the muzzle adapter 14 to apply torque for the purpose of disassembly, for cleaning and servicing.

Indeed, disassembly of the assembly 10 may be effected by rotating the entire assembly 10 to disengage the threaded portion of the muzzle adapter 14 from the muzzle. The takedown tool 16 can then rotated clockwise to disengage it from the suppressor 12 (and threaded portion 34 thereof). The takedown tool 16 can then be flipped around and slid over the proximal end of the adapter 14 so that the opening 30 engages the engagement surface 26 of the muzzle adapter 14. The tool 16 can then be utilized like a wrench to apply loosening torque to remove the muzzle adapter 14 from the suppressor 12.

Figure 8:
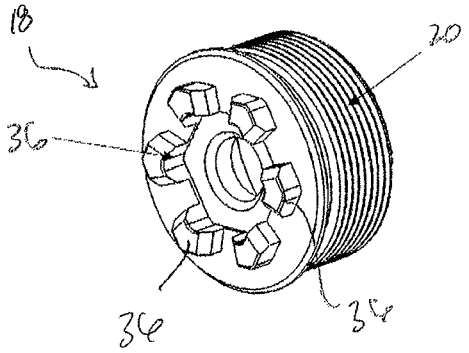
FIG. 8 is a perspective view of an end cap of a sound suppressor of the system of FIG. 1.

Referring finally to FIG. 8, the end closure 18 of the suppressor 12 may also include a plurality of projections 36 defining peripheral surfaces that are arranged to generally form a feature that can likewise be engaged by the opening 30 in the device 16. For example, the projections 36 may form a generally hexagonal shape which is sized to be received by the opening 36 of the device 16. In this respect, the takedown tool/device 16 may also be utilized to provide torque to assist in the assembly or disassembly of the end closure 18 with the suppressor body 12 for cleaning or maintenance.

Importantly, and in contrast to known systems and devices, the takedown tool 16 is an integral part of the assembly 10, rather than being a separate, loose component. Accordingly, the likelihood of losing or misplacing the tool when needed for assembly or disassembly can be obviated. Moreover, by integrating the takedown tool 16 into the assembly or system 10, the takedown tool 16 provides the additional function of preventing or minimizing inadvertent loosening of the suppressor by maintaining compression between the muzzle adapter 14 and suppressor 12.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of this disclosure.

What is claimed is:

1. A firearm accessory attachment system, comprising:

a muzzle adapter having a body having a proximal end and a distal end, the proximal end of the muzzle adapter being configured for removable attachment to a muzzle of a firearm;

a muzzle accessory removably attached to the muzzle adapter at the distal end of the muzzle adapter, the muzzle accessory having a proximal end and a distal end; and a multi-function takedown device having a first end configured to removably receive the muzzle accessory;

wherein the multi-function takedown device is configured to hold the muzzle adapter in compression relative to the muzzle accessory wherein:

the first end of the multi-function takedown device includes a female threaded portion formed on an inner peripheral surface of the multi-function takedown device, the female threaded portion being configured to threadedly receive a corresponding male threaded portion formed on an outer peripheral surface of the proximal end of the muzzle accessory.

2. The firearm accessory attachment system of claim 1, wherein:

the female threaded portion of the multi-function takedown device and the male threaded portion of the muzzle accessory each include a plurality of left-handed threads.

3. The firearm accessory attachment system of claim 2, wherein:

the proximal end of the muzzle accessory includes a female threaded portion formed on an inner peripheral surface of the muzzle accessory, the female threaded portion of the muzzle accessory being configured to threadedly receive a corresponding male threaded portion on an outer peripheral surface of the muzzle adapter.

4. The firearm accessory attachment system of claim 3, wherein:

the proximal end of the muzzle adapter includes a female threaded portion formed on an inner peripheral surface of the muzzle adapter, the female threaded portion of the muzzle adapter being configured to threadedly receive a corresponding male threaded portion formed on an outer peripheral surface of the muzzle of the firearm.

5. The firearm accessory of claim 4, wherein:

the female threaded portion of the muzzle adapter and the male threaded portion of the muzzle of the firearm each include a plurality of right-handed threads.

6. The firearm accessory of claim 1, wherein:

the muzzle adapter further includes an engagement surface intermediate the proximal end and the distal end of the muzzle adapter;

wherein a second end of the multi-function takedown device includes an opening that corresponds in shape to the engagement surface; and wherein the opening is configured to closely receive the engagement surface.

7. The firearm accessory of claim 6, wherein:

the engagement surface and the opening are hexagonal in shape.

8. The firearm accessory of claim 1, wherein:

the muzzle accessory is a sound suppressor.

9. A method for attaching a firearm accessory to a firearm, comprising the steps of:

receiving an engagement surface of a muzzle adapter within a correspondingly shaped opening in a proximal end of a multi-function retaining device;

inserting a distal end of the muzzle adapter into a proximal end of a muzzle accessory; and applying torque to the multi-function retaining device to rotate the retaining device and muzzle adapter relative to the muzzle accessory to secure the muzzle accessory to the retaining device and further comprising the step of:

coupling a proximal end of the muzzle adapter to a muzzle of a firearm and removing the multi-function retaining device from the engagement surface;

rotating the multi-function retaining device 180 degrees;

sliding the multi-function retaining device over the muzzle adapter; and threadedly coupling the multi-function retaining device to the proximal end of the muzzle accessory;

wherein the muzzle accessory and the multi-function retaining device are coupled to one another via a plurality of left-handed threads.

10. The method according to claim 9, wherein:

the engagement surface of the muzzle adapter and the opening of the multifunction retaining device are polygonal in shape.

11. The method according to claim 9, wherein:

the muzzle accessory is a sound suppressor.

12. The method according to claim 9, wherein:

the muzzle adapter and the muzzle of the firearm are coupled to one another via a plurality of right-handed threads.

13. A system for attaching a muzzle accessory to a muzzle of a firearm, comprising:

a muzzle adapter configured for attachment to a muzzle of a firearm;

a muzzle accessory configured for attachment to the muzzle adapter; and a retaining device having a first end configured to receive the muzzle accessory and a configured to exert a compressive force on the muzzle adapter, wherein:

the muzzle accessory includes a female threaded portion configured to mate with a corresponding male threaded portion of the muzzle adapter wherein:

the muzzle accessory is a sound suppressor.

14. The system of claim 13, wherein:

the muzzle adapter includes an engagement surface that is closely received within a correspondingly shaped opening in the first end of the retaining device during assembly and disassembly.

15. The system of claim 14, wherein:

the engagement surface and the opening are polygonal in shape.

* * * * *